United States Patent [19]

Guyot et al.

[11] 4,142,363

[45] Mar. 6, 1979

[54] CALENDAR WATCH MOVEMENT WITH DATE-INDICATING MEMBER

[75] Inventors: Charles Guyot, Tavannes; Jacques Müller, Reconvilier, both of Switzerland

[73] Assignee: Ebauches Tavannes S.A., Berne, Switzerland

[21] Appl. No.: 791,010

[22] Filed: Apr. 26, 1977

[30] Foreign Application Priority Data

May 3, 1976 [CH] Switzerland ..... 5530/76

[51] Int. Cl.[2] ..... G04B 19/24

[52] U.S. Cl. ..... 58/58

[58] Field of Search ..... 58/4, 8, 58, 85.5; 74/112, 436

[56] References Cited

U.S. PATENT DOCUMENTS

| | | | |
|---|---|---|---|
| 2,650,467 | 9/1953 | Faure | 58/58 |
| 3,601,976 | 8/1971 | Tripet | 58/58 |
| 3,751,901 | 8/1973 | Meitinger et al. | 58/58 |

FOREIGN PATENT DOCUMENTS

| | | | |
|---|---|---|---|
| 487446 | 4/1970 | Switzerland | 58/58 |
| 1087959 | 10/1967 | United Kingdom | 58/58 |

*Primary Examiner*—Robert K. Schaefer
*Assistant Examiner*—Vit W. Miska
*Attorney, Agent, or Firm*—Stevens, Davis, Miller & Mosher

[57] ABSTRACT

A calendar watch movement with a double cam arrangement that drives the date-indicating wheel one step every 24 hours and locks the wheel between driving periods. The first cam has a hook that engages the toothed inner portion of the date-indicating wheel and advances the wheel by one tooth each 24 hours. The cam also has an arcuate peripheral portion that fits in between two successive teeth and locks the wheel when it is not being advanced. The first cam is integral with a co-axial star wheel which is driven by a second cam having both a hook and an adjacent shoulder that advance the star extensions. The second cam is driven by the hour wheel.

7 Claims, 4 Drawing Figures

Figure 1:
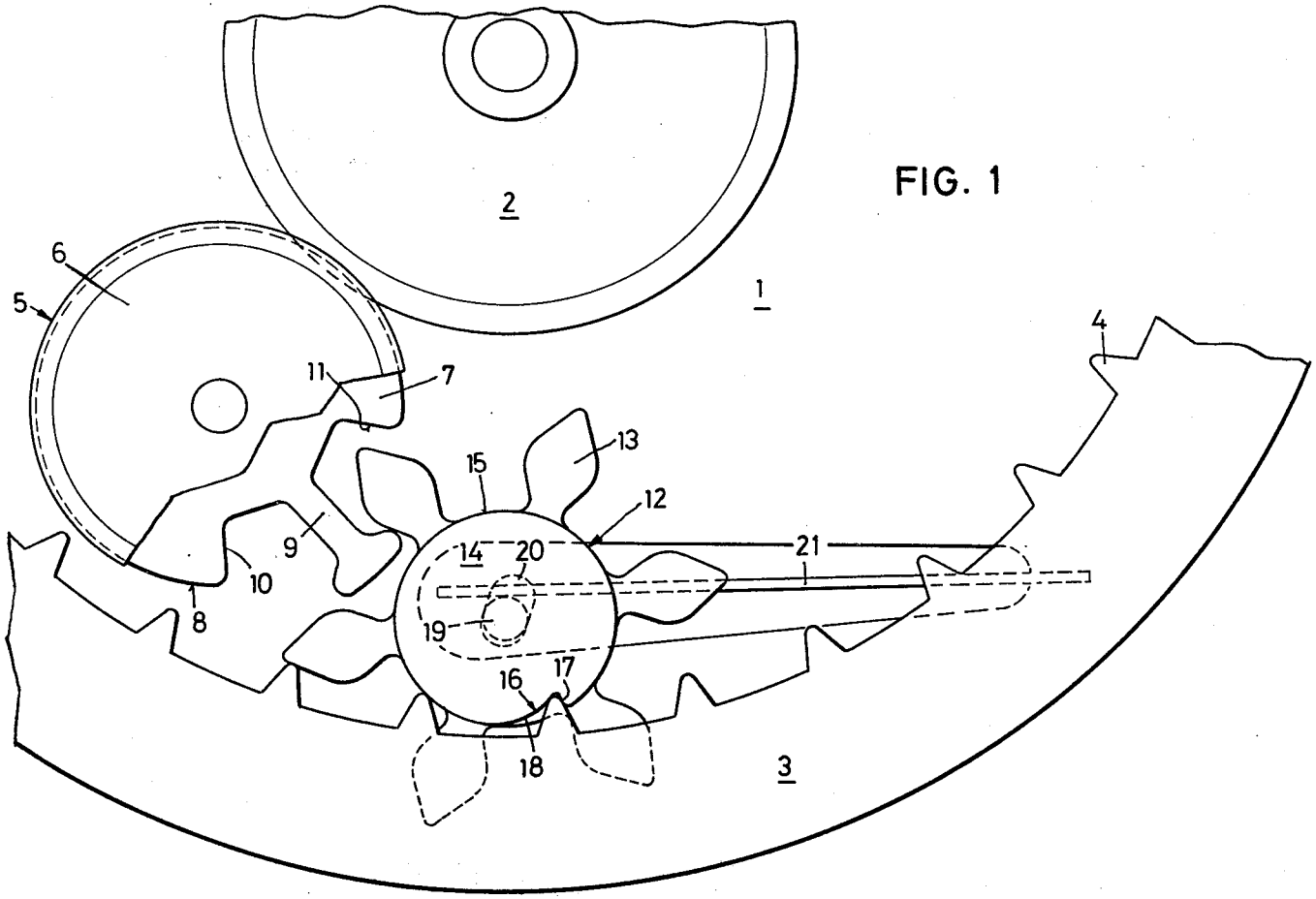

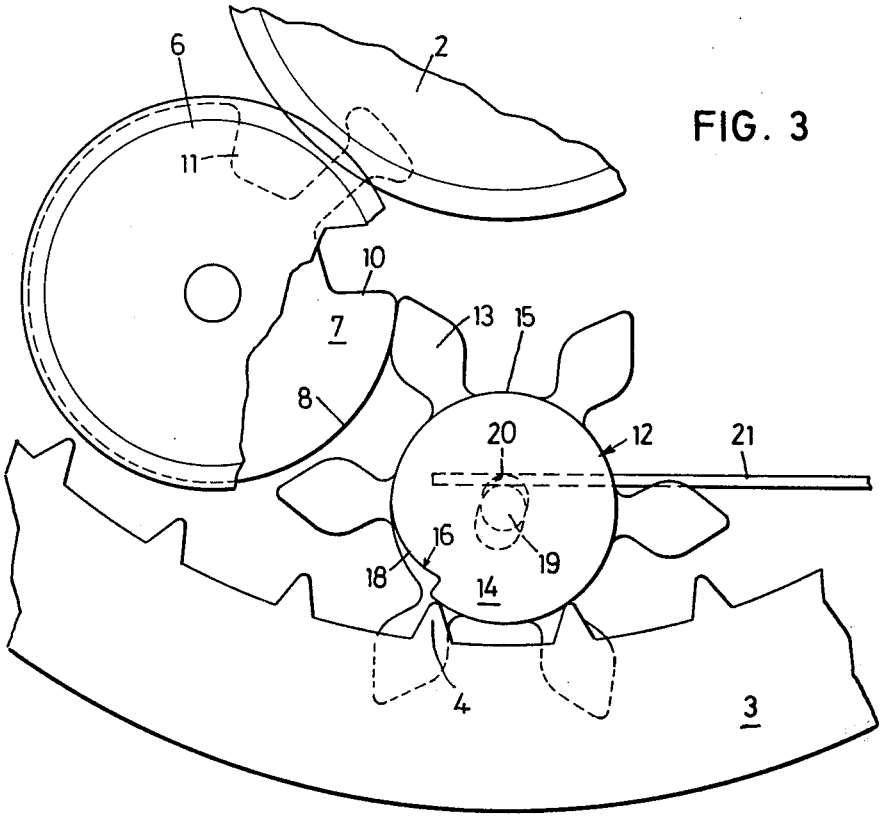
FIG. 3
FIG. 4
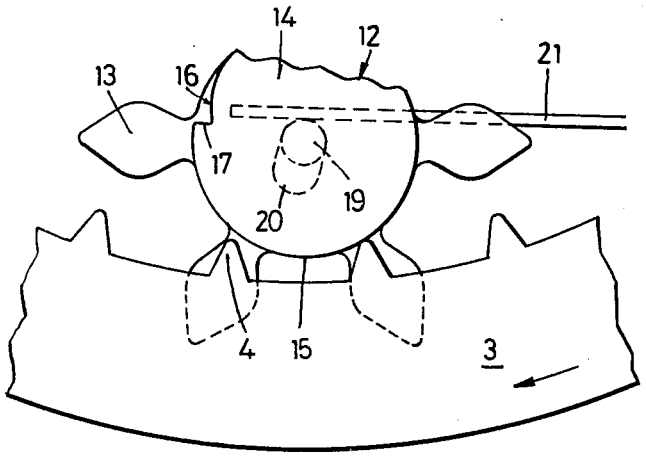

CALENDAR WATCH MOVEMENT WITH DATE-INDICATING MEMBER

This invention relates to a calendar watch movement of the type comprising a plate, an hour-wheel disposed at the center of the movement, an annular date-indicating member having an inner toothing, a rotary driving cam including an arcuate sector capable of engaging and locking the aforementioned toothing and a hook element capable of engaging and driving that toothing by one step per rotation of the driving cam, and a kinematic linkage between the driving cam and the hour-wheel.

Calendar watch movements of this type have already been proposed, particularly in Japanese Patent Application No. 1034/69 and in Swiss Patent No. 487,446 (see the corresponding U.S. Pat. No. 3,438,196). The driving mechanisms with which these known movements are equipped comprise active elements of the rotary type. In particular, the element which causes the step-by-step driving of the date-indicating member likewise causes the locking of that member between periods of driving by means of its arcuate sector which cooperates with the inner toothing of the date-indicating member. This arrangement makes it possible to do away with the fitting of a jumper acting on the toothing of the date-indicating member. Such a jumper must be biased by a spring, thus requiring that upon each shift of the date-indicating member, the driving mechanism and, ultimately, the motor organ of the movement, must develop sufficient torque to overcome the resistance of the spring. Hence the elimination of the jumper means that the force necessary to move the calendar member is much less than with jumper devices, and this considerably simplifies the whole concept of the calendar movement.

However, when it is desired to drive a date-indicating member by means of an arcuate cam which locks that member between the periods of driving, the cam must be driven intermittently and must move at a relatively high speed in order to ensure rapid shifting. In the prior art watch movements mentioned above, this high-speed intermittent movement is achieved by means of gear trains of a relatively complicated design interposed between the hour-wheel and the cam. In certain cases, this gear train includes an intermittently rotating star; and in order to hold this star during its resting periods, it remains necessary to provide a jumper.

Watch movements of the type initially mentioned are therefore of a complicated design, and it is an object of this invention to provide a simplified and improved calendar watch movement in order to take full advantage of a driving cam formed of an arcuate sector and of a driving element disposed between the ends of the sector.

To this end, in the calendar watch movement according to the present invention, the kinematic linkage comprises a calendar wheel continuously driven by the hour-wheel at a speed greater than one revolution every 12 hours, an intermediate cam integral and coaxial with the calendar wheel and including a further arcuate sector and a further hook element, and a star integral and coaxial with the driving cam and driven intermittently by the intermediate cam.

A preferred embodiment of the invention will now be described in detail with reference to the accompanying drawings, in which:

FIGS. 1 to 4 are partial top plan views showing the watch movement in different operating positions.

The drawings show part of a wrist watch movement which may be a mechanical movement or an electric movement with an analog display by means of hands. Fitted upon a plate 1, the outer limits of which are not visible in the drawing, are an hour-wheel 2 and a date-ring 3 having an inner toothing 4 with thirty-one triangular teeth of conventional appearance separated by tooth-spaces which are wider than the teeth themselves. Date-ring 3 may be guided by various elements, e.g., by a peripheral rim (not shown) of plate 1, by the inner edge of an annular recess in plate 1, or by a plate-cover which simultaneously holds the other elements of the mechanism in place. A calendar wheel 5 has a toothing 6 which meshes with the toothing of hour-wheel 2. The gear-ratio between these two wheels is such that wheel 5 is driven at a constant speed at the rate of one revolution every eight hours. Hence wheel 5 effects three revolutions every 24 hours. Beneath toothing 6 there extends a cam 7 formed in one piece therewith or rigidly secured thereto. Cam 7 comprises an arcuate sector 8 extending over about 270° and a finger 9 which is longer than the radius of sector 8. The outer edge of sector 8 is bounded by two radial shoulders 10 and 11 disposed symmetrically with respect to finger 9 and defining notches provided on each side of finger 9. Cam 7 cooperates with a calendar driving member 12 comprising, first of all, a star 13 having six diamond-shaped teeth. Disposed above star 13 is a cam 14 comprising an arcuate sector 15, which is coaxial with member 12 and extends over an angle of close to 300°, and a hook element which in this particular case is a shoulder 17 slightly inclined with respect to the radius of sector 15. Shoulder 17 forms one side of a notch 16 formed in the lateral surface of cam 14. Notch 16 is bounded by the substantially radial shoulder 17 and by a convex transition surface 18 extending from the bottom of notch 16 and joining the cylindrical lateral surface of sector 15.

Member 12 includes an arbor element 19 acting as a pivot, projecting downward and engaged in an elongated aperture 20 punched in plate 1. The longitudinal axis of aperture 20 is at a slight angle to an imaginary line joining the center of aperture 20 and the center of the movement, i.e., the center of hour-wheel 2. Thus driving member 12 can effect movements of translation in the direction determined by elongated aperture 20.

As may be seen in FIG. 1, the movement of member 12 toward date-ring 3 is limited because cam 14 comes in contact with teeth 4. As will become obvious further on, member 12 can assume different positions according to the orientation of notch 16 with respect to date-ring 3. Pivot 19 is displaced within aperture 20 against the bias of a spring 21, consisting of a simple wire disposed in a recess in plate 1 in such a way that its free end presses against pivot 19 between the level of toothing 13 and the bottom of the recess traversed by opening 20.

The mechanism is therefore very simply constituted since it includes only three different parts: calendar wheel 5, driving member 12, and spring 21. The two moving parts may be held in place by the retaining plate of date-ring 3.

Figure 2:
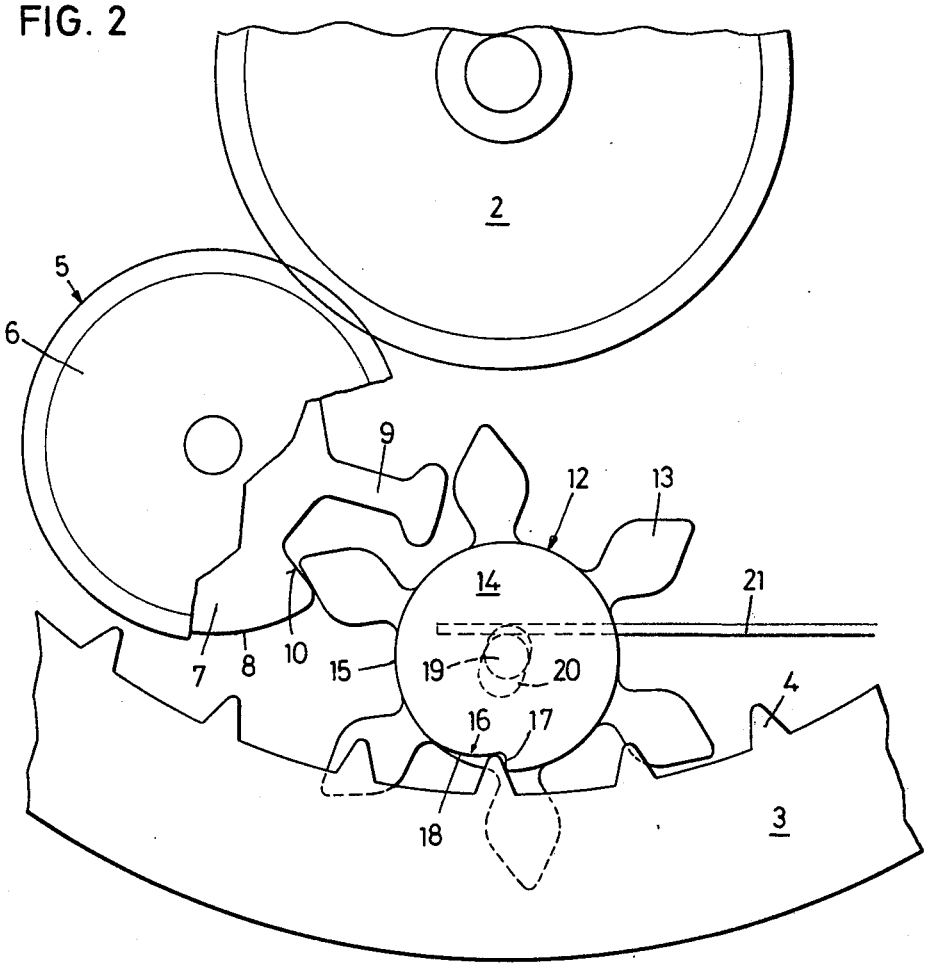

The operation of the mechanism described will become clearer if FIGS. 2 to 4 are also considered, for FIG. 1 shows the position of the mechanism when date-ring 3 starts to shift; one of the teeth 4 is engaged in notch 16, and finger 9 is hooking one of the teeth 13 so as to cause the rotation of member 12.

As shown in FIG. 2, once finger 9 causes member 12 to rotate, shoulder 10 of cam 7 hooks the following tooth 13 so that the rotation of member 12 continues until date-ring 3 has advanced by one step of its toothing. If, during that movement, member 12 undergoes a translatory displacement against the bias of spring 21, the shifting operation is not disturbed inasmuch as shoulder 10 of cam 7 brings about a forced rotation of member 12.

FIG. 3 shows the position of the mechanism at the end of the shift. Notch 16 has passed beyond the tooth 4 which has just been moved clockwise, and a portion of the lateral surface of cam 14 is pressing upon two adjacent teeth 4 under the influence of spring 21. Moreover, the lateral surface of sector 8 of cam 7 is now engaged between two teeth 13 of member 12. Although a certain clearance remains between one of the teeth 13 and the surface of sector 8, a rotation of member 12 of any appreciable amplitude is blocked. On the other hand, even if, as a result of a shock, for instance, member 12 were displaced in translation against the bias of spring 21 until pivot 19 strikes against the upper end of aperture 20, teeth 4 would not be disengaged from the surface of sector 15 sufficiently to enable any inopportune rotation of date-ring 3.

FIG. 4 illustrates the situation when a shock takes place which tends to cause date-ring 3 to rotate clockwise. One of the teeth 4 pushes member 12 back until pivot 19 strikes against the end of aperture 20, without this entailing any risk of inopportune displacement. After the shock, spring 21 returns the center of member 12 to the position shown in FIG. 3.

Thus the situation illustrated in FIG. 3 is a stable one in which date-ring 3 is locked and the possible translatory movements of member 12 are sufficiently limited so that the locking function thereof is ensured. Under these circumstances, calendar wheel 5 continues to be driven counterclockwise by hour-wheel 2. After a little less than eight hours have elapsed, finger 9 will be in the same position as in FIG. 1, so that member 12 will rotate by two steps of its toothing. However, in view of the length of the cylindrical surface of sector 15, this 120° rotation does not bring about any movement of translation of member 12, and date-ring 3 remains locked. A third rotational movement of 120° will take place eight hours later when finger 9 will, for the second time, be in the position shown in FIG. 1, and this second rotational movement will also be carried out without causing any displacement of date-ring 3. This it is not until after wheel 5 has effected three revolutions that the overall situation illustrated in FIG. 1 will recur; and as soon as finger 9 has begun causing member 12 to rotate, notch 16 is situated opposite the rear tooth 4 against which member 12 is resting, so that notch 16 engages this tooth 4 by means of a movement of translation of member 12 controlled by spring 21. Once this hooking has taken place, the rest of the rotational movement of calendar wheel 5 causes date-ring 3 to advance.

In other embodiments, cam 14 of member 12 might, if need be, include several notches 16 separated from one another by arcuate portions. In this case, calendar wheel 5 might either have more than one finger 9 or else mesh with hour-wheel 2 by a gear-ratio other than 3:2. Thus numerous variations of the device described may be conceived of by combining these different subdesigns. The hook elements of member 12 might also be projecting elements.

Thus, a driving mechanism has been provided which is very simple to produce, especially inasmuch as it comprises only very few parts, and these parts are easy to machine and to assemble. It will be noted in particular that the operation of adjusting jumpers is completely eliminated. Because of its simplicity, the mechanism is also very reliable.

Finally, the mechanism makes it possible to correct the position of date-ring 3 by actuating hour-wheel 2 by means of a conventional setting mechanism. An alternating movement between 10:30 and midnight and vice versa causes the shifting of date-ring 3.

What is claimed is:

1. A calendar watch movement comprising a plate, an annular date-indicating member having an inner toothing and mounted coaxially with respect to said plate, an hour wheel disposed at the center of the plate and continuously driven through said movement, a calendar wheel continuously driven by said hour wheel at a speed greater than one revolution every 12 hours, and a double cam arrangement for intermittently driving said date-indicating member one step every 24 hours, and for locking said member between the driving periods, said arrangement comprising a first and a second cam each of which includes an arcuate sector and a hook element, said first cam being integral with a coaxial star and pivotally mounted on said plate in such a manner that said hook element engages said toothing and drives said date indicator one step each time the first cam has effected a complete revolution, said arcuate sector locking said toothing when said hook does not engage said toothing, and said second cam being integral and coaxial with said calendar wheel and arranged in such a manner that said hook element of said second cam engages said star and drives it one step at each complete revolution of the calendar wheel.

2. The calendar watch movement of claim 1, further comprising an elongated aperture in said plate and an arbor engaged in said aperture, said first cam and said star constituting a driving member pivotable through said arbor in said aperture and displaceable in a direction perpendicular to said arbor for movement toward and away from said toothing of said date-indicating member.

3. The calendar watch movement of claim 2, further comprising a resilient member biasing said driving member for keeping said first cam engaged with said toothing.

4. The calendar watch movement of claim 3, further comprising a recess made in said plate, said resilient member being a straight wire accommodated in said recess and extending between said first cam and the bottom of said recess.

5. The calendar watch movement of claim 1, wherein said calendar wheel is driven at the rate of one revolution every eight hours, said second cam being adapted to cause said star and said first cam to rotate by steps of 120° per each complete revolution of said second cam, said hook element of said first cam driving said date-indicating member by one step of said toothing upon each complete revolution of said first cam.

6. The calendar watch movement of claim 5, wherein said star comprises six teeth and said hook element of said second cam comprises a radial finger and two radial shoulders situated one on each side of one finger and each adjacent to a respective end of said arcuate sector of said second cam, said finger and said shoulders being so disposed that said finger and one of said shoulders each drive one of said teeth upon each complete revolution of said second cam.

7. The calendar watch movement of claim 1, wherein said inner toothing comprises triangular-shaped teeth separated by tooth-spaces which are wider than said teeth, said first cam further including a shoulder and a notch bounding said hook element, said shoulder joining one end of said arcuate sector, and an edge of said notch joining the other end of said arcuate sector.

* * * * *